US008235547B2

(12) United States Patent
Hofmann

(10) Patent No.: US 8,235,547 B2
(45) Date of Patent: Aug. 7, 2012

(54) LED LAMP WITH DIFFUSER

(75) Inventor: Harald Hofmann, Luedenscheld (DE)

(73) Assignee: Osram AG, Munich (DE)

( * ) Notice: Subject to any disclaimer, the term of this patent is extended or adjusted under 35 U.S.C. 154(b) by 108 days.

(21) Appl. No.: 12/682,905

(22) PCT Filed: Oct. 9, 2008

(86) PCT No.: PCT/EP2008/008548

§ 371 (c)(1),
(2), (4) Date: Jul. 6, 2010

(87) PCT Pub. No.: WO2009/049824

PCT Pub. Date: Apr. 23, 2009

(65) Prior Publication Data

US 2010/0296281 A1 Nov. 25, 2010

(30) Foreign Application Priority Data

Oct. 15, 2007 (DE) ..... 10 2007 049 581
Nov. 12, 2007 (DE) ..... 10 2007 054 206

(51) Int. Cl.
*F21S 4/00* (2006.01)

(52) U.S. Cl. ..... 362/235; 362/249.02

(58) Field of Classification Search ..... 362/217.01, 362/222, 223, 217.05, 217.08, 249.02, 260, 362/294, 311.02, 235
See application file for complete search history.

(56) References Cited

U.S. PATENT DOCUMENTS 4,053,766 A * 10/1977 Brass ..... 362/301
4,148,095 A * 4/1979 Haynen ..... 362/223
5,001,613 A * 3/1991 Foster et al. ..... 362/223
5,954,423 A 9/1999 Logan et al.
6,709,131 B1 3/2004 Herst et al.
7,207,695 B2 4/2007 Coushaine et al.
2003/0210546 A1 * 11/2003 Chin ..... 362/249
2004/0120152 A1 6/2004 Bolta et al.
2005/0135098 A1 6/2005 Currie et al.
2006/0120107 A1 6/2006 Pao et al.
2006/0164831 A1 7/2006 Lai

FOREIGN PATENT DOCUMENTS

DE 20115794 U1 * 3/2002
DE 20115794 U1 4/2002
DE 102005054422 A1 5/2006
GB 2366610 A 3/2002
KR 100762277 B1 10/2007

OTHER PUBLICATIONS

The English translation of the international preliminary report on patentability of the International application No. PCT/EP2008/008548.

International Search Report of PCT/EP2008/008548 mailed Jan. 30, 2009.

English language abstract of KR 100 762 277 B1.

English machine translation of DE 201 15 794 U1.

* cited by examiner

*Primary Examiner* — David V Bruce

(57) ABSTRACT

A lamp is provided. The lamp may include one or a plurality of LED elements; and a housing with electrical and mechanical connection elements, wherein the housing has a light exit region with a light-transmissive terminating element, wherein the terminating element is an optical diffuser element, wherein the terminating element is of a form in which the wall of the terminating element has in cross section two opposite, straight sections running towards one another.

21 Claims, 7 Drawing Sheets

Fig. 1
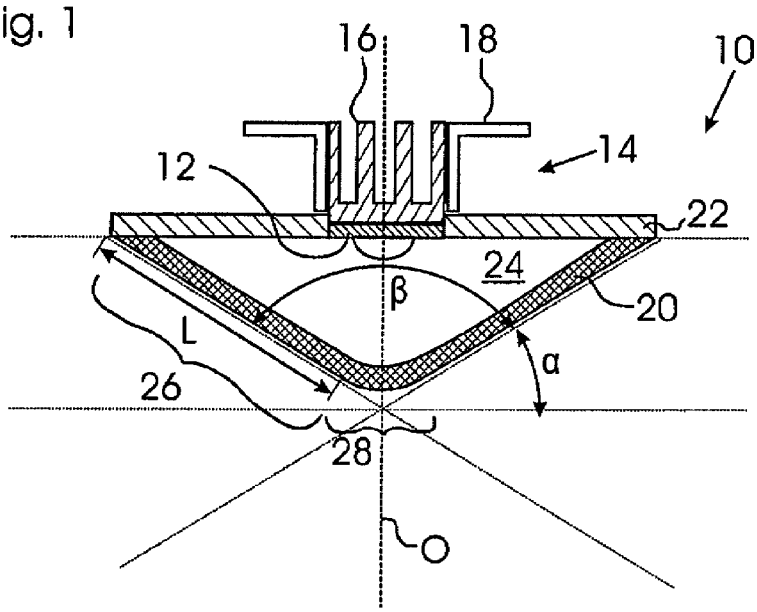
Fig. 2
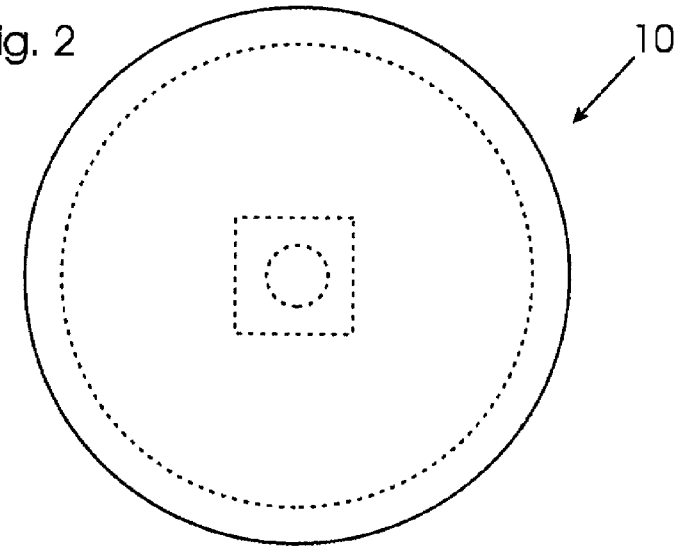
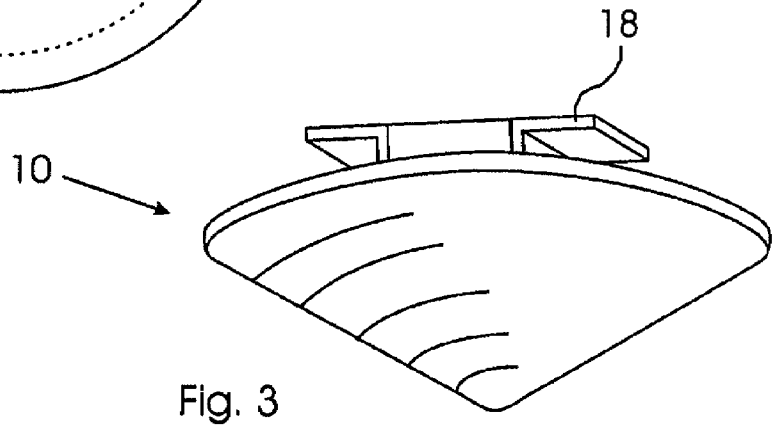
Fig. 3

LED LAMP WITH DIFFUSER

RELATED APPLICATIONS

The present application is a national stage entry according to 35 U.S.C. §371 of PCT application No.: PCT/EP2008/008548 filed on Oct. 9, 2008, which claims priority from German application No.: 10 2007 049 581.3 filed on Oct. 15, 2007 and from German application No.: 10 2007 054 206.4 filed on Nov. 12, 2007.

TECHNICAL FIELD

Various embodiments relate to an LED lamp.

BACKGROUND

A lamp is understood to mean a product in which an electrical light source is connected to further electrical, optical and/or mechanical elements to form an inseparable unit. Such a lamp is only ever intended in its entirety for replaceable accommodation in a luminaire.

U.S. Pat. No. 5,954,423 discloses a diffuser for the illumination of sign panels. A line of LED elements illuminates a substantially transparent and preferably textured diffuser element having a tent-shaped configuration. In one preferred embodiment, the diffuser element is elongate and is used together with a row of LEDs applied on a carrier, wherein posts hold the diffuser element at a distance from the carrier.

KR-B-100762277 describes a fully terminated LED lamp. An LED element is arranged within a reflector and illuminates a semicircular covering. Structures for light diffusion are provided on the surface of the covering.

SUMMARY

Various embodiments provide a lamp which is well suited to accommodation in a reflector, e.g. a mirror reflector. Various embodiments furthermore provide a suitable combination of a lamp with a reflector.

The lamp according to the invention has one or a plurality of LED elements as light sources. The latter are fitted to the lamp housing, wherein they are preferably thermally connected to a heat sink, particularly preferably composed of metal. The heat sink can be part of the lamp, but equally an external heat sink can also be used.

The housing has electrical and mechanical connection means. The latter can have any desired form, in principle, and serve for mechanical fitting at the location of use, e.g. in a luminaire, and also for electrical connection to a current-voltage supply and/or control. The lamp furthermore has a light exit region closed off with a light-transmissive terminating element. Preferably, the LED element itself is arranged in the interior, preferably in a manner such that it is completely terminated, with the result that no contamination or mechanical impairment is possible.

According to the invention, the terminating element is an optical diffuser element. In other words, a translucent, diffusely scattering element is involved. Such an element can consist e.g. on a material such as glass or plastic in which scattering particles are provided within the material (volume scattering). As an alternative, it is also possible to produce the body of the diffuser element itself from transparent material and to provide scattering merely at the inner or outer surface thereof, e.g. by corresponding surface coating, by applying a diffusely scattering film by adhesive bonding, or by forming light-refracting surface structures, e.g. micro-optical units which lead to diffuse scattering. The diffuser element can consist of colored, i.e. non-white, material for decorative purposes. It is also possible for the diffuser element to be coated on the inside with a phosphor that is visibly luminous as a result of UV excitation.

According to the invention, the terminating element is of a specific form that is manifested in cross section. In the case of said form, the wall of the diffuser element has in cross section two opposite, straight sections running towards one another. The two sections merge into one another in their further course; in this case, they meet at a vertex point, the point of intersection of the two straight lines or in a rounded transition. Preferably, the wall is formed from the straight sections at least over half of its length in cross section, particularly preferably to an extent of more than 60%.

A lamp according to the invention is particularly expedient for many illumination applications:

The lamp has the outstanding properties of LED illumination with regard to long lamp lifetime, high luminous efficiency and large choice of light colors.

As a result of the diffuse scattering at the diffuser element, the relatively high luminances of the LED elements are distributed substantially uniformly over a larger area and the luminances are reduced or the luminance distribution is homogenized. Particularly when different-colored LEDs are used, a homogeneous additive light mixing becomes possible in this way.

As a result of the specific geometry of the diffuser, the lamp is additionally outstandingly suitable for use in a luminaire, preferably with a mirror reflector, in particular with a parabolically shaped reflector.

The straight wall sections of the terminating element form the diffuser element angle $\beta$ with respect to one another in cross section. As is explained in connection with preferred embodiments, said angle, in the case of use in a reflector, is linked to the shielding angle $\alpha$ of the luminaire. Given optimal utilization of the space available for the lamp installation, the doubled lamp shielding angle $2\alpha$ and the diffuser element angle $\beta$ in this case supplement one another to form 180°.

In this case, the diffuser element angle $\beta$ can be chosen, on the one hand, in a manner dependent on a predetermined lamp shielding angle. In order to achieve an optimal utilization in the case of a predetermined lamp shielding angle of 20°, for example, a diffuser element angle of 140° is well suited. It is alternatively possible, of course, given the same predetermined lamp shielding angle of 20° in the example discussed, to choose a more obtuse diffuser element angle $\beta$, e.g. 150° or 160°. In this case, avoidance of multiple reflections would furthermore be ensured, although with somewhat worsened utilization of the maximum possible lamp value. In general, therefore, it can be stated that, in order to avoid multiple reflections, it is preferred to choose the diffuser element angle $\beta$ with a value of at least $180°-2\alpha$ given a predetermined lamp shielding angle $\alpha$, that is to say e.g. to choose a diffuser element angle of at least 120° given a lamp shielding angle of 30°, which is preferred in practise, and an angle $\beta$ of at least 100° given $\alpha=40°$. In general, therefore, it is preferred to choose the diffuser element angle such that it is not overly acute, for example greater than 80°, preferably greater than 90°.

On the other hand, in order to obtain a large lamp volume with good utilization, it is preferred to define the diffuser element angle $\beta$ at not more than 140°, with further preference at not more than 120°, such that, with good utilization, relatively high values are nevertheless obtainable for the lamp shielding angle $\alpha$ (at least 20°, preferably 30° or more).

In two preferred embodiments, the light exit region, in the plan view of the lamp, is either substantially round (this also includes small deviations from the round form, e.g. elliptical forms) or substantially elongate (that is to say that the longitudinal extent is greater than the transverse extent, the longitudinal extent preferably amounting to at least 1.5 times, particularly preferably more than 2 times, the transverse extent). The cross-sectional geometry according to the invention can be identical in both cases.

In the case of the lamp having an elongate light exit region, the latter—as seen from the main emission direction—is preferably rectangular. In this case, the diffuser element is preferably embodied as cylindrical, that is to say that it has substantially the same cross section over the longitudinal extent of the lamp. For a homogeneous lamp luminance at the diffuser element, a plurality of LED individual elements or element groups (clusters) are preferably arranged one behind another in the longitudinal direction of the lamp.

The lamp having a substantially round light exit region is preferably rotationally symmetrical, wherein the axis of symmetry lies centrally with respect to the terminating element in the main emission direction. The terminating element has the form of a cone envelope, that is to say that its wall follows the form of a cone envelope at least in the region in which the straight sections appear in cross section. In the further course, the cone can taper to a point, where it is preferred for the cone apex to be rounded.

Furthermore, for the lamp having a round light exit region, it is provided that the LED elements are arranged symmetrically with respect to the main emission direction. In the case of an individual LED element, the latter is preferably arranged exactly in the center. As an alternative, a plurality of LED elements can be arranged such that they form a substantially symmetrical arrangement, e.g. a 3×3 matrix.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIG. 1 shows a schematic cross-sectional view of a first embodiment of an LED diffuser lamp;

FIG. 2 shows a plan view of the diffuser lamp from FIG. 1;

FIG. 3 shows a perspective view of the lamp from FIGS. 1, 2;

DETAILED DESCRIPTION

Figure 4:
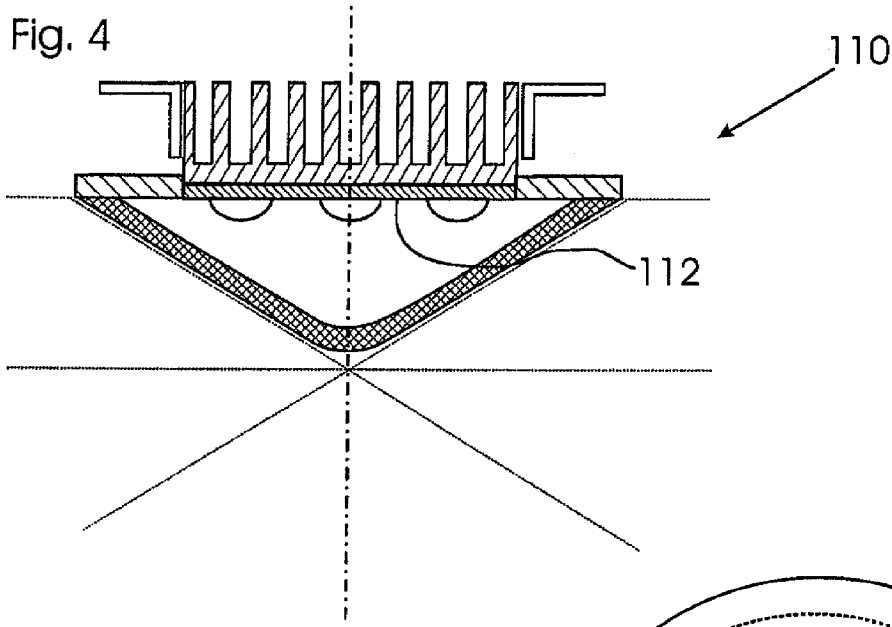
FIG. 4 shows a schematic cross-sectional view of a second embodiment of an LED diffuser lamp.

The following detailed description refers to the accompanying drawings that show, by way of illustration, specific details and embodiments in which the invention may be practiced.

FIG. 1 shows, in a schematic cross-sectional view, a first embodiment of a lamp 10, which is illustrated further in FIG. 2 and FIG. 3. This first embodiment is a compact, rotationally symmetrical LED lamp. An individual LED element 12 with one LED chip or a plurality of LED chips on a circuit board is provided as luminous means. Such LED elements having a power sufficient for illumination applications are known and will therefore not be explained in greater detail below.

The lamp 10 has a base system 14 with a heat sink 16 and holding brackets 18. Heat sink 16 and LED element 12 are fixedly connected to a round baseplate 22, which together with a diffuser element 20 encloses a lamp interior space 24. The elements of the lamp 10, i.e. base system 14, LED element 12, baseplate 22 and diffuser 20, are connected to one another in a non-releasable manner, e.g. by welding or adhesive bonding, such that the lamp 10 forms one unit which is only ever replaceable in its entirety. The LED element 12 illuminates the diffuser element 20 through the interior space 24 terminated in an air-tight fashion.

The diffuser element 20 is a shell-shaped element having translucent, diffusely scattering optical properties. This has the effect that the diffuser element 20, upon illumination by the LED element 12, diffusely scatters the light thereof and thus itself acts as an areal, secondary light-limiting element. In other words, from outside, the form of the LED element 12 is not manifested as a primary light-limiting element, rather the outer form of the diffuser element is perceived as luminous. In the case of correspondingly non-directional emission by the LED element 12, this results in a relatively homogeneous luminance distribution at the diffuser element 20.

Figure 13:
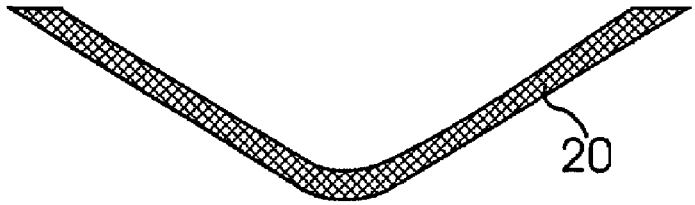
FIGS. 13, 14, 15 show cross-sectional views of different embodiments of diffuser elements.

In the preferred example shown, the diffusely scattering properties of the diffuser element 20 are produced by volume scattering at the wall, that is to say that the material of the diffuser element 20 has scattering particles inside (FIG. 13). Such a behavior is obtained for example by means of a material such as glass, plastic or ceramic, for example, in which scattering particles are provided within the material.

Figure 14:
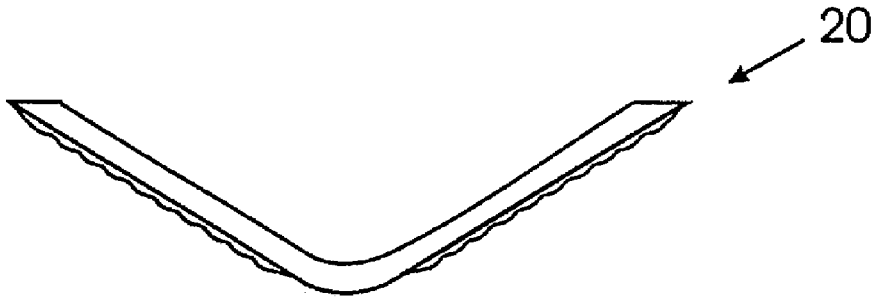
Figure 15:
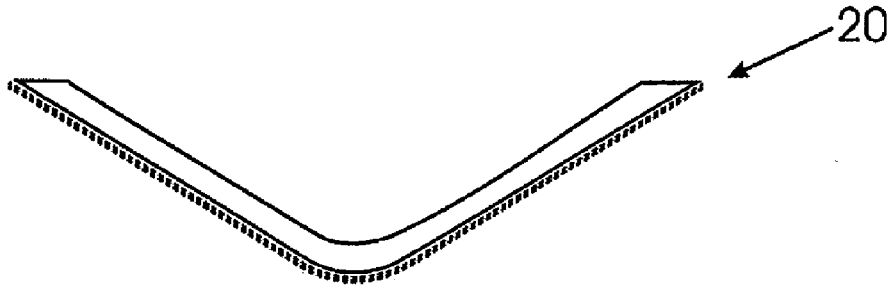

As an alternative, it is also possible to produce the body of the diffuser element 20 itself from transparent material (e.g. glass, plastic) and to obtain diffuse scattering by forming surface structures, as illustrated by way of example in FIG. 14. Furthermore, it is possible to provide a transparent diffuser element with a diffusely scattering surface coating fitted on the inside or on the outside, for example a diffusely scattering film, as illustrated in FIG. 15. In all cases it is possible to use colored material instead of white material, in order to obtain color effects including e.g. with white LEDs.

The lamp 10 has a light exit region, which, in the example shown, is formed by the region surrounding the diffuser element 20, that is to say that the lamp 10 emits light in a substantially converted fashion. Nevertheless, a central optical axis O can be defined as a center axis of the light emission, which corresponds to the axis of symmetry in the example of a rotationally symmetrical lamp shown. Viewed from a point on said axis, the light exit region of the lamp 10 appears round (FIG. 2).

The diffuser element 20 is of a very specific outer form which is particularly well suited to use in a reflector luminaire, as illustrated below with reference to FIG. 16. As can be discerned in the cross section of FIG. 1, the diffuser element 20 is formed from two identical, cross-sectionally straight sections 26 arranged in symmetrical fashion, and a rounded transition section 28 situated therebetween. The outer contour is crucial in this case, wherein the diffuser element has a substantially constant wall thickness in the preferred example shown, such that the inner form corresponds to the outer form.

In the case of the rotationally symmetrical form shown, the outer contour of the diffuser element 20 corresponds to a truncated cone envelope in the region of the straight sections 26, and to a rounded apex of a cone at the rounded region 28, as can be seen from FIG. 3, in particular.

In the example shown, the straight sections 26 extend from the baseplate 22, in the plane of which the LED element 12 is arranged. At the straight sections 26, the outer contour of the diffuser element 20 runs straight over a distance L. In this case, the straight regions 26 and the rounded transition region 28 are coordinated with one another such that the lengths L of the straight sections 26 preferably constitute the predominant portion, i.e. over half of the contour line. The proportion can be even considerably higher, for example above 60% or more than 80% as in the example illustrated.

The straight sections 26 run towards one another at an angle β (diffuser element angle), with the result that a certain depth of the interior space 24 is formed.

Figure 16:
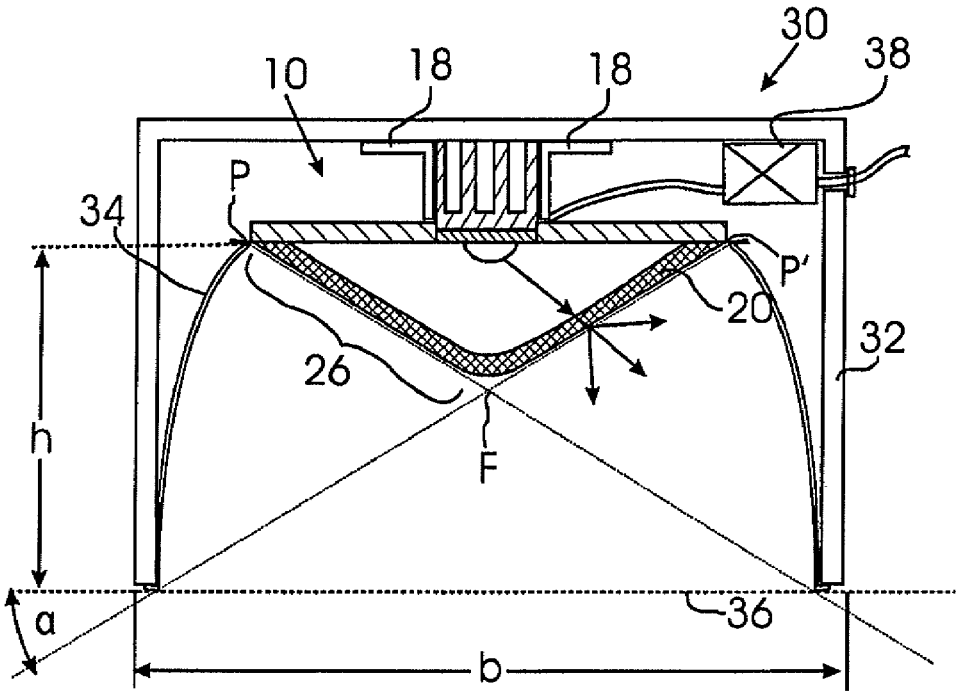
FIG. 16 shows a schematic cross-sectional view of a luminaire with a lamp in accordance with the first embodiment.

FIG. 16 schematically shows a luminaire 30 in which the lamp 10 described above is incorporated. The luminaire 30 includes a rotationally symmetrical reflector 34 in a cylindrical luminaire housing 32. A light exit plane 36 is formed at the termination of the reflector. Within the housing 32, the lamp 10 is mechanically fixed with the aid of the installation brackets 18 and electrically connected to an operating unit 38, which firstly converts the power supply voltage supplied into values for current and voltage that are required for the operation of the LED chip 12, and secondly performs control functions such as switching on/off and, if appropriate, dimming (for example by means of corresponding modulation), color control (for example by means of corresponding selective driving of different-colored LEDs with different powers), etc.

In the cross-sectional illustration of FIG. 16, the centrally crossing lines depicted can be depicted on the parabolic reflector 34 in each case between the upper reflector edge and the opposite lower reflector edge. They define the lamp shielding angle α, within which the lamp 10 with its luminance is not directly visible from outside and is thus masked out. In the example of FIG. 16, the contour of the reflector 34 is a parabola with the focal point F and the vertex P (or P', opposite), that is to say that the parabola axis is inclined by the angle 90°−α with respect to the perpendicular. In this case, a conical space designated by the isosceles triangle F, P, P' is available as lamp installation space, wherein all light rays emitted from this space are emitted or reflected by the reflector 34 at an angle that is greater than α, and are therefore masked out within the cut-off angle αoutside the luminaire 30. In the case of the geometrical relationships shown, the lamp light emerges from the luminaire after only single reflection, and multiple reflection is avoided.

As illustrated in FIG. 16, the diffuser 20 of the lamp 10 is shaped such that it utilizes the available lamp installation space well. The straight sections 26 run parallel at the crossing lines, and, in the example shown, they form the angle α with the baseplate 22. This ensures that, firstly, the lamp 10 is arranged only within the lamp installation space (triangle F, P, P') and, secondly, the available space is utilized well and, as a result, the light from the LED element 12 is distributed over a maximum area.

For a given angle α, the reflector height or the luminaire installation depth h is thus minimized together with minimization of the reflector width b or the luminaire volume. The luminaire efficiency is optimized by means of the good utilization of the lamp installation space and the condition of single reflection.

In the example shown, the lamp 10 has the rounded transition section 28 for production engineering reasons. As an alternative, said section can extend with greater curvature, through to the formation of a point, such that the outer contour of the diffuser element 20 then has a complete cone envelope form.

The diffuser element 20 can be shaped differently for different purposes of use, namely have different diffuser element angles β. By way of example, it may be predetermined for the luminaire 30 that a shielding angle α of 30° is intended to be obtained. As can be discerned from FIG. 16, with best possible utilization of the lamp installation space (straight sections 26 run parallel at the crossing lines), β+2α supplement one another to form 180°. That is to say that, in order to obtain a shielding angle α of 30°, a lamp having a diffuser element angle β of 120° would be optimal. However, alternatively—given a somewhat smaller lamp surface—it is also possible, of course, for a given shielding angle α, to use lamps having a less steep form (in other words a larger diffuser element angle β). In that case, although the lamp 10 is situated within the lamp installation space, it does not entirely fill the latter, with the result that the straight sections 26 no longer run parallel to the crossing lines.

In practise, shielding angles α of 30° or 40° are preferred for luminaires. In this case, an optimal utilization is obtained by means of diffuser element angles β of 120° (in the case of α=30°) or respectively 100° (in the case of α=40°).

Figure 5:
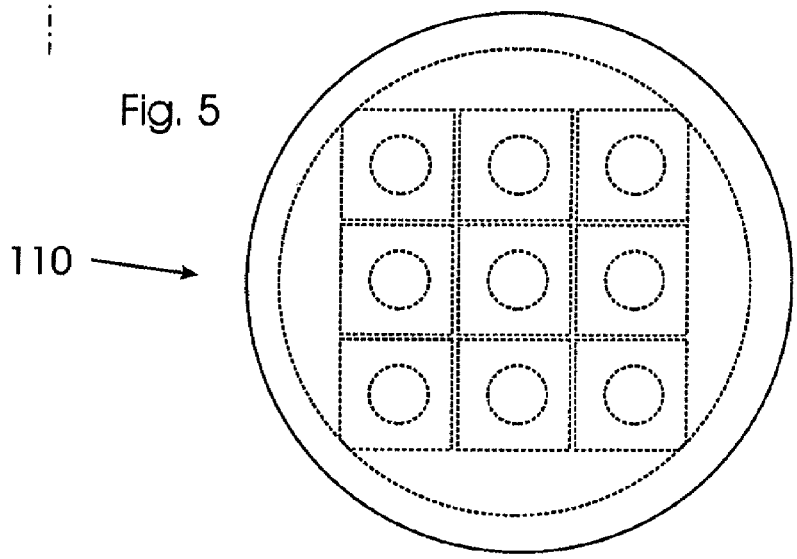
FIG. 5 shows a plan view of the diffuser lamp from FIG. 4.
Figure 6:
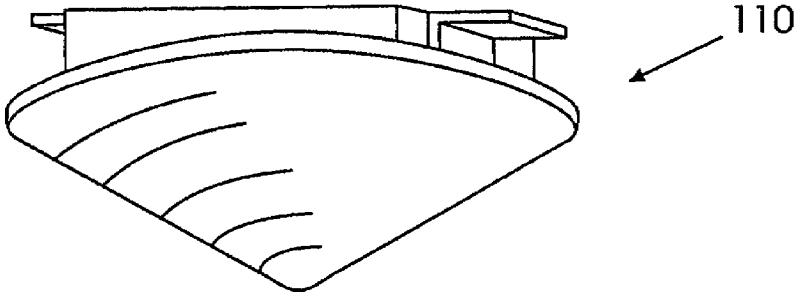
FIG. 6 shows a perspective view of the lamp from FIGS. 4, 5.

The concept described above on the basis of the compact lamp 10 can also be applied to other types of lamp. Thus, FIG. 4 to FIG. 6 show a second embodiment of a rotationally symmetrical compact lamp 110, which largely corresponds to the first embodiment of a compact lamp 10. In contrast thereto however, an LED cluster 112 is provided rather than an individual LED element. In the example shown, the LED cluster 112 consists of a 3×3 LED element. In this case too, the diffuser 20 serves as a secondary light source which adds the contributions of the individual LED light sources as homogeneously as possible.

Figure 7:
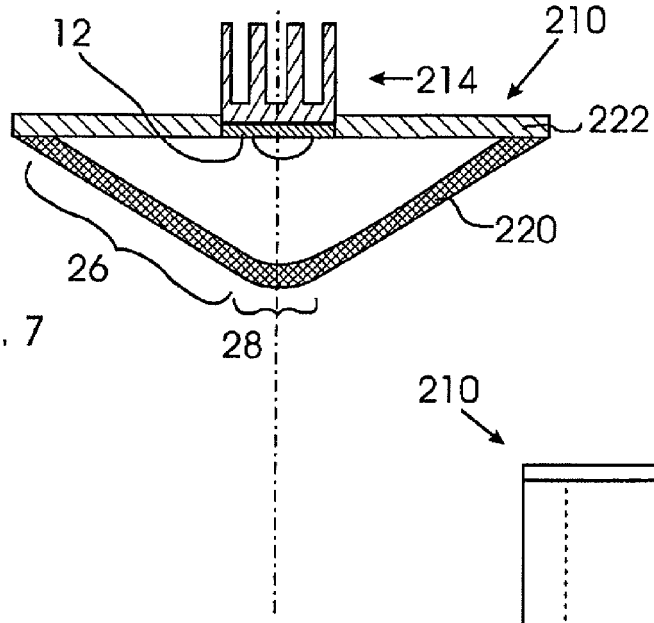
FIG. 7 shows a schematic cross-sectional view of a third embodiment of an LED diffuser lamp.
Figure 8:
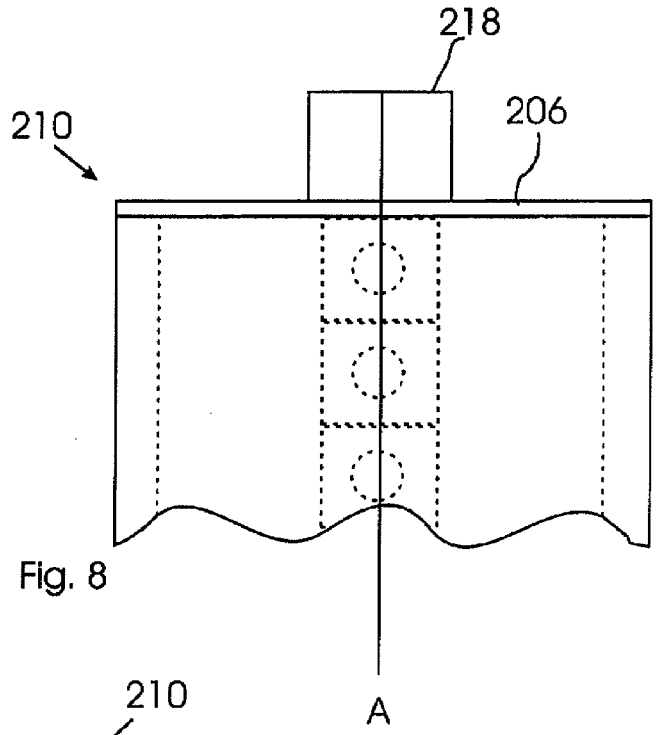
FIG. 8 shows a plan view of the diffuser lamp from FIG. 7.
Figure 9:
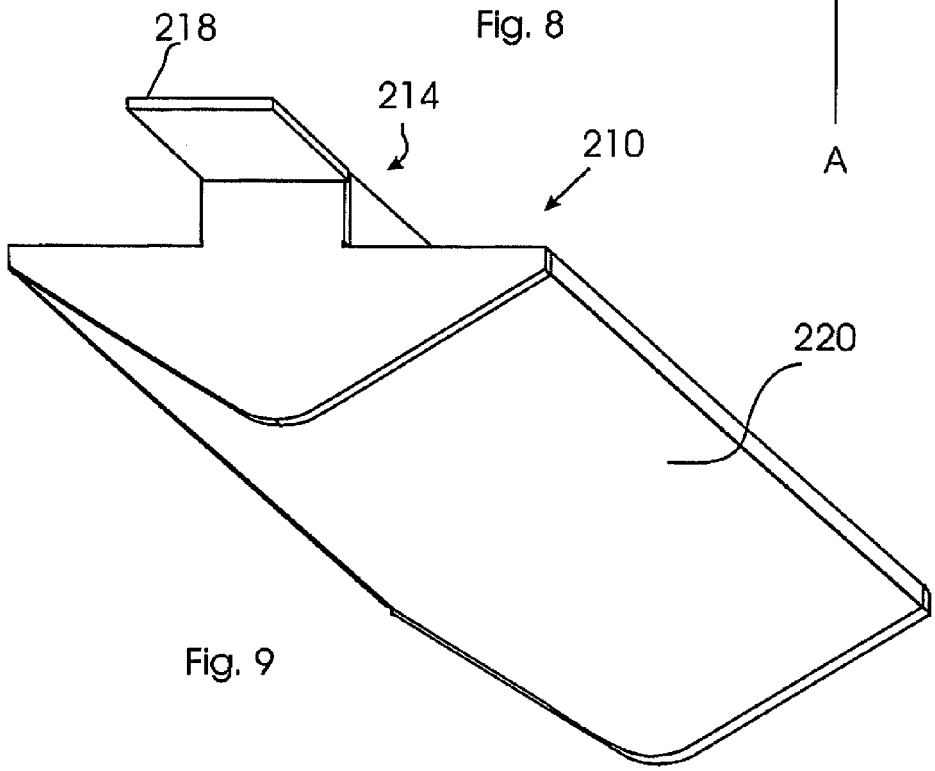
FIG. 9 shows a perspective view of the lamp from FIGS. 6, 7.

In the case of the third embodiment shown in FIG. 7 to FIG. 9, although the lamp 210 shown therein largely corresponds in cross section to the compact lamp 10 from FIG. 1, in contrast thereto what is involved is not a rotationally symmetrical lamp, but rather a linear lamp extending in a straight fashion in the direction of a longitudinal axis A. It has an elongate light source, which, in the example shown, is formed by LED element 12 strung together in the direction of the longitudinal axis A.

The lamp 210 has a rectangular baseplate 222 and a light exit region which is rectangular in the plan view of a central optical axis (FIG. 8). The mechanical fixing is effected by holding brackets 218 at the end side in the case of the linear lamp 210.

The diffuser 220 is of cylindrical form, that is to say that it has in the direction of the longitudinal axis A a constant cross-sectional form shown in FIG. 7 (which corresponds to the cross-sectional form in the rotationally symmetrical variant, FIG. 1). Here, too, proceeding from the baseplate 222, straight sections 26 and a rounded transition section 28 are provided. The lamp 210 is terminated by a terminating plate 206 at the end side. A base system 214 with heat sink and holding brackets 218 at the end side is likewise embodied in elongate fashion.

The linear lamp 210 can have different structural lengths. It is preferably elongate in the direction of the axis A, that is to say that its longitudinal extent is greater than its transverse extent. Possible designs are, for example, a transverse extent of 2-10 cm, preferably 5-8 cm, and longitudinal dimensions of preferably more than 10 cm, for example 30 cm or more.

Figure 17:
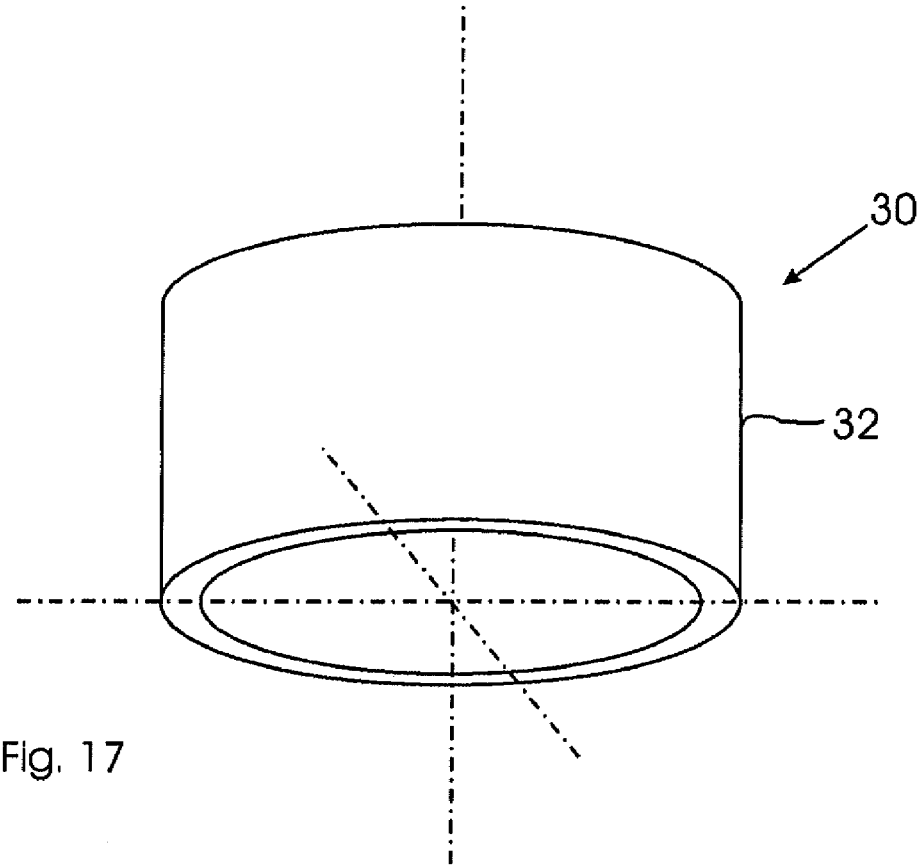
FIG. 17 shows a perspective view of the luminaire from FIG. 16.
Figure 18:
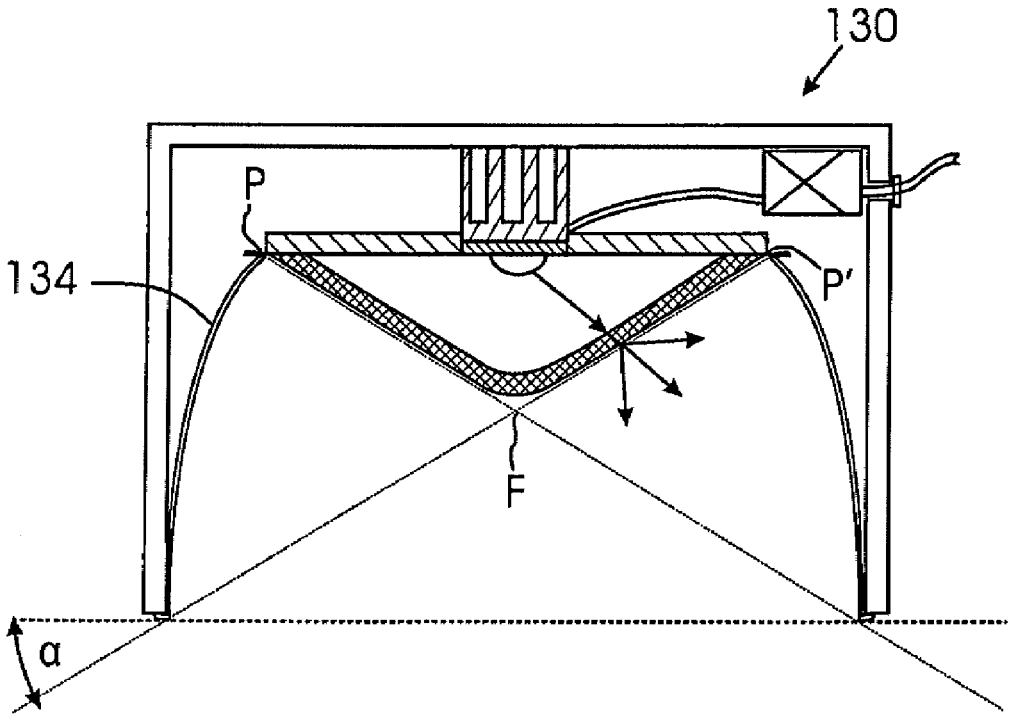
FIG. 18 shows a schematic cross-sectional view of a luminaire with a lamp in accordance with the second embodiment.
Figure 19:
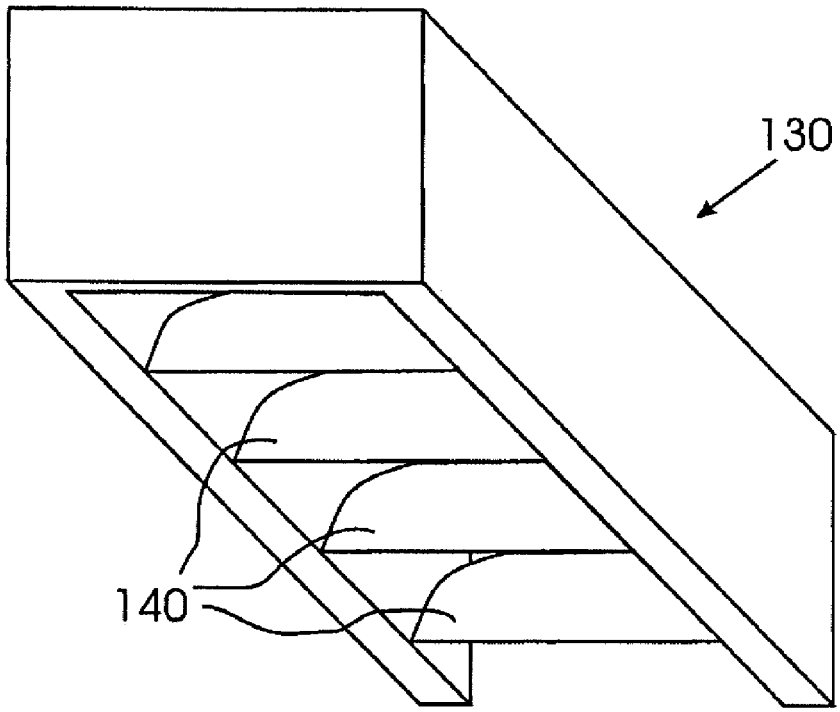
FIG. 19 shows a perspective view of the luminaire from FIG. 18.

The linear lamp 210 can be used in a linear reflector luminaire 130 as shown in FIGS. 18, 19. Apart from the elongated instead of rotationally symmetrical form, the linear reflector luminaire 130 corresponds to the compact reflector luminaire 30 explained above in connection with FIGS. 16, 17, and so the same geometrical considerations with regard to a lamp installation space and the utilization thereof are applicable here. The linear reflector lamp 130 has a cylindrical linear reflector 134, which in cross section likewise has the parabolic form already described in connection with FIG. 16. In the case of the arrangement shown, it is ensured that the lamp light emerges from the luminaire 130 after at most only single reflection at the linear reflector 134. As shown in FIG. 19, the linear reflector luminaire can have lamellae 140 spaced apart over its length.

Figure 10:
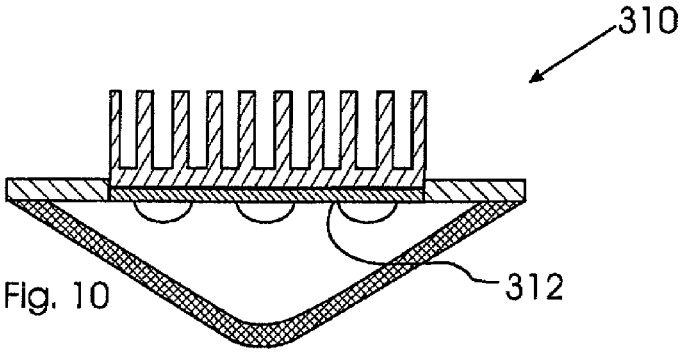
FIG. 10 shows a schematic cross-sectional view of a fourth embodiment of an LED diffuser lamp.
Figure 11:
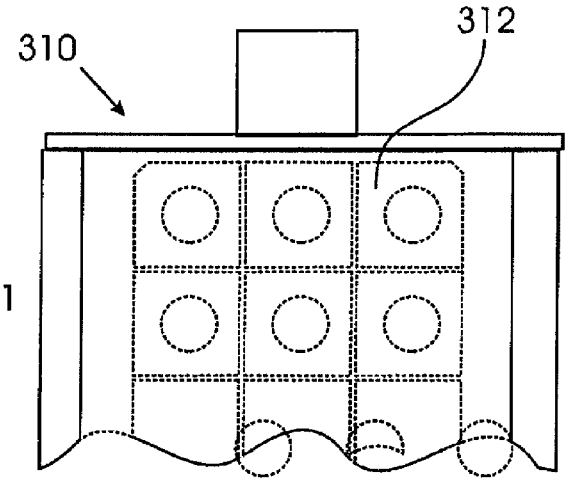
FIG. 11 shows a plan view of the diffuser lamp from FIG. 10.
Figure 12:
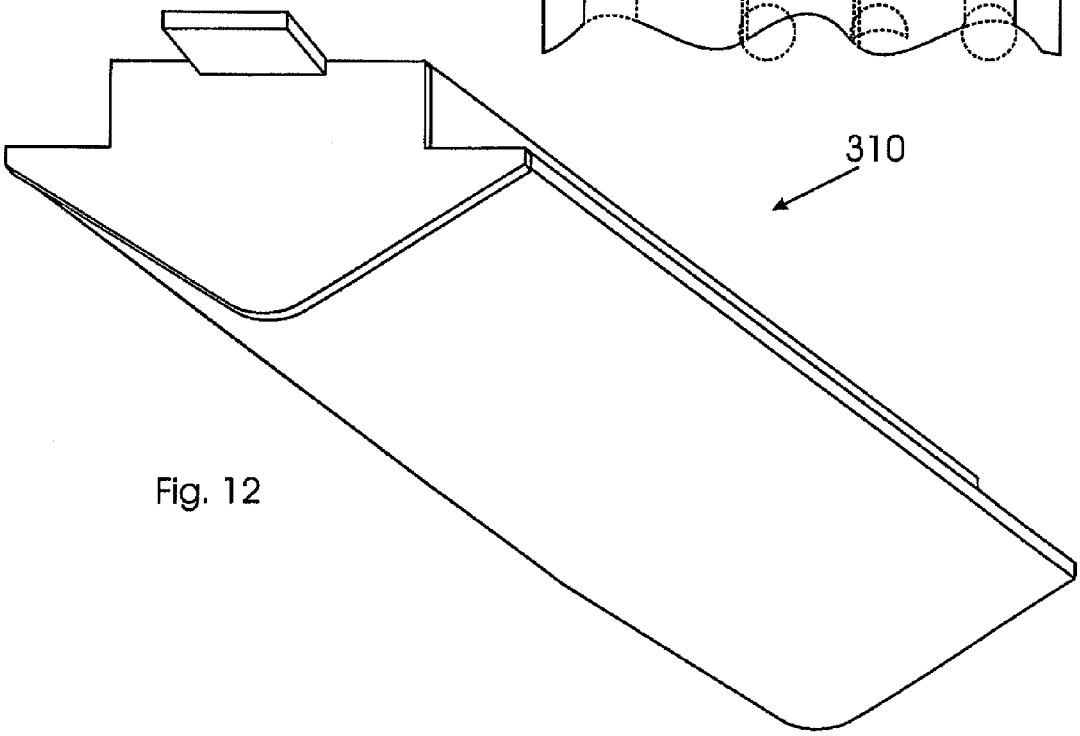
FIG. 12 shows a perspective view of the lamp from FIGS. 10, 11.

As a further embodiment of a lamp, a further linear lamp 310 is illustrated in FIG. 10 to FIG. 12. It corresponds to the greatest possible extent to the third embodiment of a linear lamp 210 (FIG. 7 to FIG. 9) and differs therefrom merely in that, rather than an individual row of LED elements, a—in the example shown—3-row cluster 312 of LED elements is provided as the light source.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. An assembly, comprising:

a lamp, the lamp, comprising:

one or a plurality of LED elements; and a housing with electrical and mechanical connection means, wherein the housing has a light exit region with a light-transmissive terminating element, wherein the terminating element is an optical diffuser element, wherein the terminating element is of a form in which the wall of the terminating element has in cross section two opposite, straight sections running towards one another, and a reflector, wherein the reflector is embodied in such a way, and the lamp is arranged within the reflector in such a way, that light emitted by the lamp emerges after only single reflection and multiple reflection is avoided.

2. The assembly as claimed in claim 1, wherein the wall is formed from the straight sections at least over half of its length in cross section.

3. The assembly as claimed in claim 1, wherein the housing has a baseplate, which together with the diffuser element terminates an interior space, wherein the straight sections of the wall extend at an angle from the baseplate in cross section.

4. The assembly as claimed in claim 1, wherein the sections have an angle of at most 140°, with respect to one another.

5. The assembly as claimed in claim 1, wherein the sections have an angle of at least 80° with respect to one another.

6. The assembly as claimed in claim 1, wherein the wall of the terminating element has in cross section a form which is symmetrical with respect to a center axis.

7. The assembly as claimed in claim 1, wherein the LED elements are arranged on a heat sink.

8. The assembly as claimed in claim 1, wherein the housing is terminated and the terminating element is fitted thereto in a non-releasable manner.

9. The assembly as claimed in claim 1, wherein the terminating element comprises a diffusely scattering material.

10. The assembly as claimed in claim 1, wherein the terminating element comprises a transparent material coated with a diffusely scattering material.

11. The assembly as claimed in claim 10, wherein the layer is adhesively bonded on as a film.

12. The assembly as claimed in claim 10, wherein the coating is fitted on the inside on the terminating element, and wherein the LED element is configured to emit ultraviolet light that excites the coating to be luminous in the visible range.

13. The assembly as claimed in claim 1, wherein the terminating element comprises of a transparent material provided with a light-refracting surface structure.

14. The assembly as claimed in claim 1, wherein the terminating element comprises a colored material.

15. The assembly as claimed in claim 1, wherein the light exit region is embodied as at least substantially elongate, and wherein the terminating element is embodied as cylindrical.

16. The assembly as claimed in claim 15, wherein a plurality of LED elements or LED element groups are arranged one behind another in the longitudinal direction of the lamp.

17. The assembly as claimed in claim 1, wherein the light exit region is at least substantially round, and wherein the terminating element is embodied in the form of a cone envelope at least in a first region.

18. The assembly as claimed in claim 17, wherein the terminating element is rotationally symmetrical with respect to a central light exit axis in the main emission direction.

19. The assembly as claimed in claim 17, wherein a plurality of LED elements are arranged at least substantially symmetrically around the center of the round light exit region.

20. The assembly as claimed in claim 1, wherein the reflector has a shielding angle, and wherein the cross-sectionally straight sections of the wall of the diffuser element of the lamp form a diffuser element angle with respect to one another, wherein the diffuser element angle is equal to or greater than 180°—twice the shielding angle.

21. A lamp, comprising:

one or a plurality of LED elements; and a housing with electrical and mechanical connection means, wherein the housing has a light exit region with a light-transmissive terminating element, wherein the terminating element is an optical diffuser element, wherein the terminating element is of a form in which the wall of the terminating element has in cross section two opposite, straight sections running towards one another, wherein the terminating element comprises a transparent material coated with a diffusely scattering material, wherein the coating is fitted on the inside on the terminating element, and wherein the LED element is configured to emit ultraviolet light that excites the coating to be luminous in the visible range.

* * * * *